United States Patent [19]

Bujalski

[11] 4,434,420

[45] Feb. 28, 1984

[54] INTERLINE SPACING ADJUSTMENT CIRCUIT IN A SCANNING CRT VISUAL DISPLAY SYSTEM

[75] Inventor: Joseph Bujalski, Roselle, Ill.

[73] Assignee: Motorola, Inc., Schaumburg, Ill.

[21] Appl. No.: 390,588

[22] Filed: Jun. 21, 1982

[51] Int. Cl.[3] ..... G09G 1/16

[52] U.S. Cl. ..... 340/724; 315/395; 340/749; 358/180

[58] Field of Search ..... 340/724, 749; 315/395; 328/186, 187; 358/180

[56] References Cited

U.S. PATENT DOCUMENTS

| | | | |
|---|---|---|---|
| 4,019,090 | 4/1977 | Wolff et al. . | |
| 4,158,837 | 6/1979 | Zahorsky . | |
| 4,237,458 | 12/1980 | Lantz et al. . | |
| 4,240,075 | 12/1980 | Bringol . | |
| 4,310,840 | 1/1982 | Williams et al. | 340/724 |

OTHER PUBLICATIONS

Motorola VP38 Service Manual, 10/81, pp. 16/21.
HG46505R CRT Controller (CRTC) Users Manual, Hitachi Microcomputer System HMCS 6800, Publication HLN014.
Hitachi Series HD46505 (CRTC) Publication HLN013.
The Complete Motorola Microcomputer Data Library (1978), pp. 1-159 through 1-177.

*Primary Examiner*—David L. Trafton
*Attorney, Agent, or Firm*—James W. Gillman; James S. Pristelski; Phillip H. Melamed

[57] ABSTRACT

A scanning CRT visual display system is provided in which the operation of the CRT controller which provides video blanking pulses and horizontal and vertical sync pulses for controlling the CRT display is temporarily halted when a larger than normal vertical spacing between horizontal scan lines is desired. During the time that the operation of the CRT controller is halted, which is accomplished by the selective blocking of clock timing pulses to the controller, an auxiliary synchronous counter circuit effectively counts the clock timing pulses and provides a substitute horizontal sync pulse for the CRT display such that during the implementation of a larger than normal vertical step for the scanning CRT display system, horizontal sync pulses are always provided even though the operation of the CRT controller is temporarily suspended during this time.

12 Claims, 3 Drawing Figures

INTERLINE SPACING ADJUSTMENT CIRCUIT IN A SCANNING CRT VISUAL DISPLAY SYSTEM

BACKGROUND OF THE INVENTION

The present invention relates generally to the field of raster scanning CRT visual display systems in which circuitry is utilized to provide for at least two different vertical spacings between sequential horizontal scan lines in a raster scan visual display system.

In CRT raster scanning visual display systems, the information to be displayed typically is provided by a microprocessor. This information is normally supplied to a CRT controller circuit which generates the horizontal and vertical display sync pulses as well as a display timing signal that determines the horizontal and vertical video blanking times which correspond to the occurrence of the horizontal and vertical sync pulses. In addition, the typical visual display system also utilizes a refresh memory circuit wherein information concerning the visual display to be provided in a single display frame is received from the microprocessor and stored for later recall by the operation of the CRT controller circuit. Also, such systems utilize a character generator which receives control signals from the CRT controller circuit and display information signals from the refresh memory circuit and in response thereto provides scan excitation signals to a video control circuit that determines the video excitation to be provided on the CRT screen. This video excitation comprises the timed activation of a scanning CRT electron beam gun to produce a desired display character at a desired location on the CRT screen. The operation of the above-identified basic visual display system is well known to those of average skill in the video display system art, and therefore additional details explaining the operation of such systems are not believed to be necessary.

The present invention is more particularly related to adjustment circuits which alter the normal vertical spacing between seqential horizontal raster scan lines provided for the CRT visual display. Typically the video beam, or video beams in the case of a color CRT display, are swept horizontally across the CRT screen from left to right during an active portion of a display timing signal. During a non-active portion, the video gun beam follows a retrace path to a slightly lower initial left side position. In accordance with the occurrence of a subsequent sync pulse the beam again implements an active scan across the CRT screen but this time at a slightly altered vertical position. At the end of scanning the entire CRT screen to produce a visual display frame, a vertical sync pulse is received by the CRT resulting in resetting the beam to the top left hand corner of the screen and the entire process is repeated.

It is known that in some instances it is desired to provide a larger than normal vertical space between sequential active video horizontal lines of video information provided by the CRT video gun. This permits the CRT to display desired information in a desired visual format. Preferably this feature should be implemented without requiring the refresh memory to repetitively provide blank video signal information for each blank horizontal scan line to be implemented to create a larger than normal vertical spacing between video active horizontal scan lines. One such system which provides an adjustable vertical spacing between horizontal scan lines is illustrated in U.S. Pat. No. 4,019,909 which is assigned to the same assignee as the present invention.

In this prior system typically a vertical shift for a larger than normal vertical space between sequential horizontal scan lines is implemented by a separate vertical deflection control signal during a single retrace time of the video beam in order to minimize disruption of the visual display. However, many times a substantial increase in the normal vertical spacing between horizontal lines is desired such that this increased vertical spacing cannot be implemented during the short duration retrace time. This can be due to the vertical deflection circuits of the CRT being unable to rapidly respond to a vertical step control signal during the short retrace time.

The present invention provides for selectively implementing a larger than normal vertical step while utilizing a standard CRT controller circuit and preventing any disruption of the produced visual display. The present invention also provides a selective vertical spacing adjustment circuit which, while it can be operated independently to provide a larger than normal vertical spacing, can also be utilized in conjunction with prior vertical step adjustment circuits to insure the proper operation of these prior circuits even when the normal response time of the vertical deflection control apparatus would prevent the use of such prior circuits to provide a completed large desired vertical step just during the short retrace time between horizontal scan lines.

SUMMARY OF THE INVENTION

An object of the present invention is to provide a scanning CRT visual display system having a horizontal interline spacing adjustment circuit for providing selectable vertical spacing between horizontal scan lines without disrupting the visual display being provided.

In one embodiment of the present invention a scanning CRT visual display system is provided in which sequential horizontal visual display lines having predetermined vertical interline spacings between are selectively provided. The display system comprises: a CRT controller circuit means for providing vertical and horizontal sync pulses for controlling CRT electron beam sweeping which produces said sequential horizontal visual display lines that together form a composite visual display frame, clock means coupled to said CRT controller circuit means for providing thereto fixed frequency clock timing pulses which determine the occurrence of said vertical and horizontal sync pulses, and a CRT display station which includes a CRT for receiving said vertical and horizontal sync pulses, as well as video information signals, and providing said composite visual display frame in accordance therewith; the improvement comprising an adjustable vertical spacing horizontal interline control circuit comprising the combination of; terminal means for receiving a vertical step control signal indicative of a desired increase in the normal vertical interline spacing between sequential horizontal scan lines; gate means coupled between said clock means and said controller circuit means and also coupled to said terminal means for selectively preventing, for a predetermined time, said clock pulses from being received by said controller means in response to at least the occurrence of said step control signal, thereby effectively halting the operation of said controller circuit means; counter means coupled to said terminal means and said clock means for effectively counting said clock pulses during the time that said clock pulses are prevented from being received by said controller circuit means and for providing at least one substitute horizontal sync pulse in response to said counter means attaining a predetermined count of said clock pulses; and signal combiner means coupled to said controller circuit means and said counter means for effectively combining said controller circuit horizontal output sync pulses and said substitute horizontal sync pulses to provide a composite horizonal sync control signal which is coupled to said CRT for control of said CRT visual display, whereby during the implementation of an increase of the normal vertical spacing between sequential horizontal display lines, horizontal sync pulses are effectively continuously provided even though the time required for implementing the increased vertical spacing may exceed the retrace time normally provided between sequential horizontal visual display lines.

Essentially, the present invention provides for temporarily halting the operation of the CRT controller means during the implementation of the increased vertical step between sequential horizontal scan lines. During this vertical step implementation the interline spacing adjustment circuit of the present invention effectively operates as an auxiliary horizontal sync pulse generator to provide at least one substitute horizontal sync pulse such that the horizontal scanning of the CRT continues in sync during the implementation of the vertical step. This provides for increasing the vertical space between video active horizontal scan lines since the operation of the controller means which provides active video display information, by recalling video information stored in a refresh memory circuit, is effectively suspended, but horizontal CRT scanning continues in sync resulting in an increase in the vertical space between active horizontal scan lines.

The present invention permits utilization of a large separate vertical step pulse during the suspension of the controller and therefore provides not only a single retrace time for implementing the vertical step, but provides for the utilization of at least an additional horizontal sweep time and horizontal retrace time, thereby substantially increasing the time available for any separately controlled vertical deflection circuit of the CRT to implement a large desired vertical step within one visual display frame. The operation of the controller means is effectively suspended during the implementation of the increased vertical step wherein the controller is allowed to resume its operation after completion of the vertical step.

The present invention allows adjustable vertical spaces between horizontal character rows in accordance with received vertical step command signals wherein the time for implementing the vertical step can be readily matched to the response characteristic of the vertical deflection circuits of the CRT if a large vertical step is to be implemented by a separate vertical deflection control signal during the time. It should be noted that the CRT controller means is contemplated as also providing the video blanking control signal (display timing signal) such that at the time the present invention implements the desired increased vertical step, the operation of the CRT controller means is halted during the ocurrence of a video blanking signal provided by the CRT controller means. Thus there will be no apparent disruption of the video display due to either the absence of a horizontal sync pulse or the occurrence of undesired active video signals during the implementation of the increased vertical step.

BRIEF DESCRIPTION OF THE DRAWINGS

For a more complete understanding of the present invention reference should be made to the drawings, in which.

DESCRIPTION OF THE PREFERRED EMBODIMENT

Figure 1:
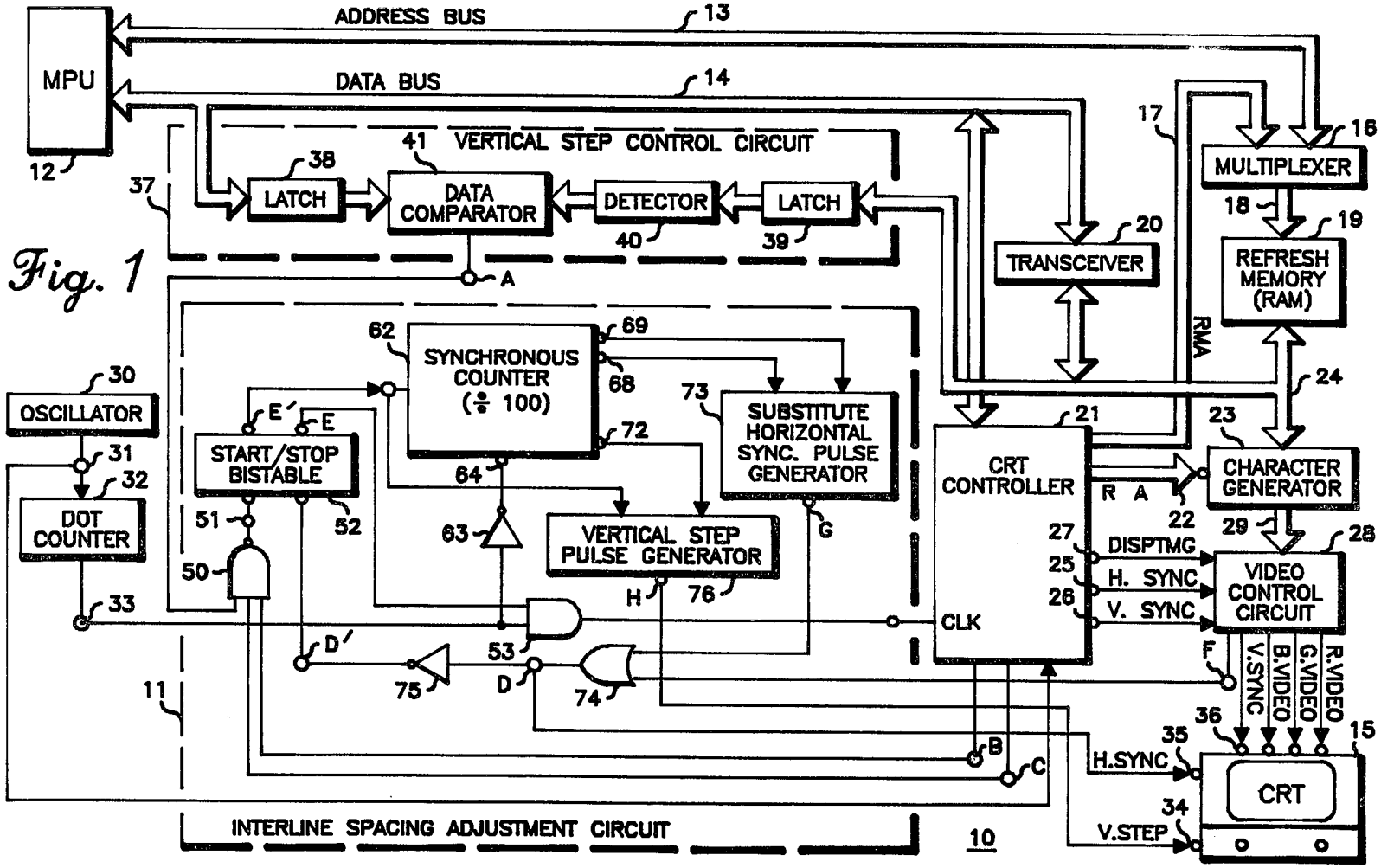
FIG. 1 is a schematic diagram of a scanning CRT visual display system which incorporates the horizontal interline spacing adjustment circuit of the present invention.

FIG. 1 illustrates a raster scanning CRT visual display system 10 which incorporates a horizontal interline spacing adjustment circuit 11 (which comprises the essence of the present invention), the remaining portions of the display system 10 comprising standard and well known elements of a raster scanning video display system.

In the display system 10, a microprocessor 12 provides display information by means of an address bus 13 and a data bus 14, the information from the microprocessor being in digital form and being utilized to define a desired visual display to be produced on a cathode ray tube (CRT) screen of a CRT display station (terminal) 15. The address bus 13 is coupled as an input to a multiplexer circuit 16 which receives an additional address input by virtue of a refresh memory address (RMA) bus 17. Essentially, the multiplexer 16 selects which one of the address buses 13 or 17 will be provided via an output address bus 18 as address information to a refresh memory circuit 19 which is used to store display information data received from the microprocessor 12 via the data bus 14. The multiplexer is controlled by the microprocessor 12.

The data bus 14 is coupled to a transceiver 20 which is bidirectionally coupled to the refresh memory 19 to enable the loading of data into the refresh memory 19 as well as the reading of data out of the refresh memory by the microprocessor 12. The data bus 14 is also bidirectionally coupled to a standard CRT controller circuit 21 which is initially programmed by the microprocessor to determine the format of the visual display to be produced by the CRT display station 15. Essentially, the CRT controller circuit 21 receives a fixed frequency character clock signal at an input terminal CLK and this signal determines, in conjunction with the data received from the microprocessor data bus 14, the timing of the raster scanning which is to be utilized by the display system 10 in order to produce a visual display at the CRT display station 15.

The primary outputs of the CRT controller circuit 21 comprise refresh memory address signals provided on the bus 17, raster address signals provided on a bus 22 to a character generator circuit 23 that receives character generation signals from the refresh memory circuit 19 by means of a bus connection 24, and horizontal and vertical raster display sync signals provided at terminals 25 and 26, respectively. All of the outputs of the controller circuit 21 are determined in accordance with the clock input signal of the CRT controller circuit. In addition, the CRT controller circuit 21 provides a display timing (DISPTMG) signal at a terminal 27 wherein the signal at the terminal 27 defines the permissable video active field and video blanking timing to be used for deflectable video electron gun or guns used to produce the visual display for the CRT display station 15.

The terminals 25 through 27 are coupled as inputs to a video control circuit 28 which receives the control signals at the terminals 25 through 27 along with character dot generation information supplied by the character generator 23 via a data bus 29. Essentially, the video control circuit receives the basic timing signals for a raster scan display from the CRT controller and also receives character generation information via the bus 29 and provides in response thereto video CRT gun activation signals as well as vertical and horizontal sync signals to the display station 15 which in response thereto provides a visual display consisting of a frame of information which is repetitively scanned to provide a persistent image on the CRT screen. Typically the video control circuit 28 provides horizontal and vertical sync signals to the display station and these signals correspond to the horizontal and vertical sync signals provided at the controller circuit terminals 25 and 26. The normal horizontal sync output signal of the video control circuit 28 is provided at a terminal F. In the display system 10 it is contemplated that the CRT display station 15 is a color terminal and that therefore the video control circuit 28 provides separate red (R), green (G), and blue (B) video gun activation control signals to the CRT terminal 15. However, the present invention will also operate in substantially an identical manner with single color CRT display stations.

The display system as described above essentially corresponds to typical raster visual display systems in common use today. The operation of each of the elements recited above is well known to those of average skill in the visual display systems design art and therefore details concerning the operation of these elements will not be discussed. The refresh memory circuit 19 and character generator 23 sequentially provide character display signals to the display station to produce a visual display frame, and they are controlled by the controller circuit 21. It should be noted that preferrably for operation of the present invention the CRT controller circuit 21 comprises either the Hitachi HD46505R CRT controller or the Motorola MC6845 CRT controller. Both of these controller circuits are readily available and extensive literature exists describing not only the controller itself but the visual display systems with which these controllers are intended to operate in conjunction with.

As is well known in visual display systems similar to the display system 10, character display information is provided for the CRT display station 15 by the signals on the bus 29 which define the character to be visually displayed in terms of an array of dots. The number of horizontal dots which comprise each of the characters separatey identified by the signals on the bus 29 is determined by an oscillator circuit 30 and a dot counter 32. The oscillator 30 provides a high frequency output signal at a terminal 31 that is coupled as an input to the dot counter 32 which provides at a terminal 33 a character clock signal. Essentially the dot counter 32 is merely a frequency divider and the character clock signal at the terminal 33 merely comprises a fixed frequency repetitive signal indicative of a predetermined number of pulses which occur at the oscillator output terminal 31. The function of the character clock signal at terminal 33 is to provide a signal in synchronization with the oscillator 30 which is repetitive for a predetermined number of oscillator pulses wherein this number of oscillator pulses comprises the number of horizontal dots that define the horizontal width of the character array provided for each of the different character generator signals possibly provided on the bus 29 to the video control circuit 28. It should be noted that the oscillator terminal 31 is also directly coupled to the video control circuit 28 and is utilized to selectively provided activation for the red, green and blue video gun control signals when it is desired to activate any of those video guns during the scanning process.

Typically in prior visual display systems the terminal 33 at which the character clock signal is provided is directly connected to the CLK input terminal of the CRT controller circuit 21 and the vertical and horizontal sync outputs of the video output control circuit 28 are directly provided as inputs to the CRT display station 15. In addition, the CRT display station 15 has a vertical step input terminal 34 wherein if a separate predetermined signal is applied to this terminal during the horizontal scanning process a vertical step between horizontal scan lines is provided. It should be noted that the present invention contemplates typical raster scanning for the CRT display station 15 wherein sequential horizontal lines are scanned from left to right during an active portion of the video scanning sequence and during a non-active portion of the scan a horizontal retrace occurs repositioning the electron guns to the left side of the CRT screen while implementing a normal slightly downward vertical movement of the electron beam. The commencement of each of the active horizontal scans is in synchronization with the horizontal sync pulses received at a horizontal sync terminal 35 of the display station 15 whereas the resetting of the entire scanning sequence to provide a new visual display frame is accomplished in accordance with the vertical sync signal received at a terminal 36 of the CRT terminal 15. The terminals 34 and 36 and terminal 35 are coupled to vertical and horizontal beam deflection apparatus in the display station 15, respectively.

Prior adjustable vertical step circuits exist wherein in response to a step signal at the terminal 34 an abrupt shift in the vertical position of the scanning beam or beams occurs. Visual display systems which utilize this function are marketed by Motorola Inc. wherein this specific function is referred to by the Motorola trademark "StepScan". In such visual display systems it is desirable to implement the desired vertical step after the termination of one active horizontal scan and prior to the termination of the next active horizontal scan. This saves having the refresh memory circuit 19 store blank video information signals to be recalled during an active horizontal scan which may occur during the implementation of the vertical step. This means that the entire vertical step must be implemented during the retrace time of the horizontal scanning beam. The vertical step is implemented by vertical deflection yoke circuitry in the CRT display station 15, and often this circuitry does not respond sufficiently rapidly enough to complete the implementation of the vertical step prior to the initiation of the next horizontal active scan if a large step is desired. This produces a very undesirable visual effect. The present invention overcomes this problem through the utilization of the horizontal interline spacing adjustment circuit 11 of the present invention, and the operation of this circuit will now be discussed. It should be emphasized that even without providing a vertical step signal at the terminal 34, the present invention will provide a selective increase in the normal vertical spacing between video active horizontal scan lines.

It is contemplated that in the display system 10 there exists a vertical step control circuit 37 (shown dashed) whose function is merely to provide a vertical step inhibit signal at a terminal A in accordance with whether or not the microprocessor 12 has determined that a larger than normal vertical step should occur between sequential horizontal scan lines for the raster display to be produced on the CRT display station 15. Preferably this is accomplished through the utilization of latch circuits 38 and 39, a decoder circuit 40 and a data comparator circuit 41 wherein the function of these elements is to compare a data command which has been issued by the microprocessor and held in latch 38 with data which was read out from the refresh memory circuit 19 into the character generator 23. The circuit 37 provides a signal at a terminal A which determines whether the microprocessor 12 desires to implement a larger than normal vertical spacing between sequential horizontal scan lines as the refresh memory circuit provides a read out that defines the visual display to be provided. Details of the operation of the vertical step control circuit 37 will not be discussed since its function is merely to produce a signal at the terminal A in accordance with the desires of the microprocessor 12 to implement a larger than normal vertical step. Any number of circuits can be utilized for the circuit 37 and all function properly to produce equivalent results. The present invention actually contemplates implementing a larger than normal vertical step every 12th horizontal scan line, unless inhibited by the signal at terminal A, wherein 12 horizontal scan lines define the vertical character array for a horizontal row of characters defined by the character generator 23. The signal at the terminal A merely results in the microprocessor 12 controlling if such a vertical step every 12 horizontal lines is to be implemented or inhibited. It is contemplated that if the signal at terminal A allows the occurrence of a larger than normal vertical step after 12th horizontal line, the circuit 37 will reset the signal at terminal A during the next 1st horizontal line scan which subsequently occurs for a character to be displayed.

Figure 2:
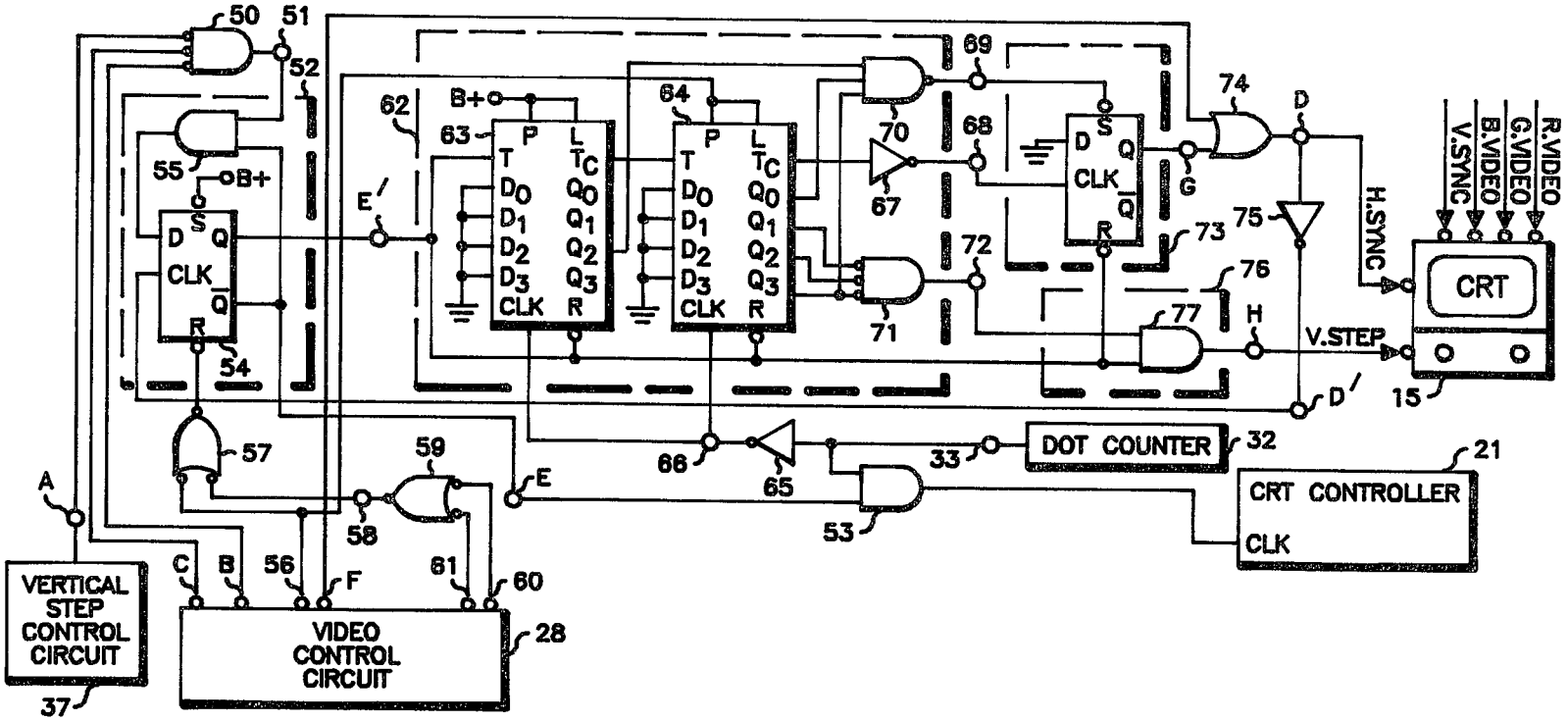
FIG. 2 is a detailed schematic diagram illustrating in detail the horizontal interline spacing adjustment circuit shown in FIG. 1.
Figure 3:
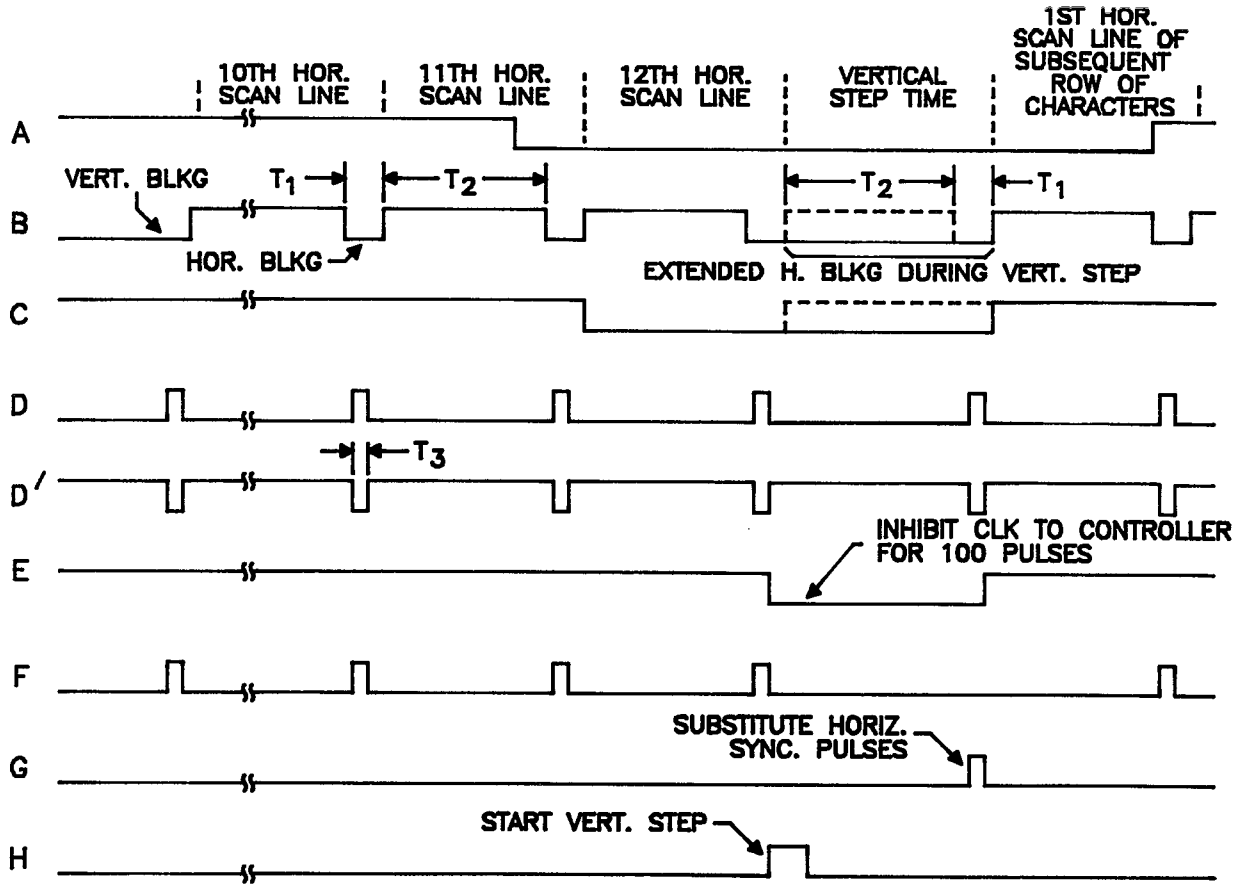
FIG. 3 comprises a series of graphs A–H which illustrate various key signal waveforms provided by the circuitry illustrated in FIGS. 1 and 2.

For a better understanding of how the present invention intends to selectively implement a large vertical step every 12 horizontal scan lines, reference should be made to the waveform A shown in FIG. 3 which is representative of the signal at the terminal A in FIGS. 1 and 2. This waveform indicates the occurrence of the tenth through twelfth horizontal scan lines, followed by the implementation of the vertical step, and then followed by the commencement of the first horizontal scan line of a subsequent group of twelve additional horizontal scan lines. It should be noted that all of the waveforms in FIG. 3 have vertical axes representative of magnitude and horizontal axes representative of time wherein each of the horizontal axes is drawn to the same time scale. It should also be noted that FIGS. 1 and 2 various terminals are designated by alphabetic designations and that the waveforms at each of these terminals correspond to the alphabetically designated graphs A through H, respectively, shown in FIG. 3. Identical components and terminals depicted in both FIGS. 1 and 2 are identified by identical reference designations.

The operation of the horizontal interline spacing adjustment circuit 11 shown in FIGS. 1 and 2 will now be explained in detail in conjunction with the waveform graphs shown in FIG. 3.

The terminal A at which a vertical step inhibit signal is provided is directly coupled as an input to a NAND gate 50 which receives additional inputs by virtue of separate additional input connections to each of terminals B and C which are provided as outputs of the video control circuit 28. Essentially, the signal provided at the terminal B actually corresponds to the display timing signal provided at the terminal 27 by the CRT controller 21. The signal at terminal B is illustrated in FIG. 3 and comprises low logic states representative of blanking of the video display throughout the occurrence of horizontal and vertical sync pulses. Video blanking exists during the horizontal sync pulses and for a predetermined time thereafter. The signal at the terminal C is provided by the video control circuit 28 and essentially merely comprises a signal which implements a low logic state during the existence of the twelfth scan line and is reset to a high logic state upon the commencement of the next active video scan line. Thus the signal at the terminal C can be readily implemented by including in the video control circuit a horizontal scan line counter which is set upon the occurrence of the twelfth scan line and is reset upon the termination of video blanking after the occurrence of the twelfth horizontal scan line. Such circuitry can be readily designed by those of the average skill in the art, and the waveforms shown in FIG. 3 illustrate the timing relationships necessary for the signal C.

It should be noted that the period of horizontal blanking shown in FIG. 3 is designated by the symbol T1, whereas the active period of the horizontal scan is designated by the symbol T2. It should be noted that during the period T1, the retrace of the horizontal scan takes place. It is also significant to note that in FIG. 3 the duration of the horizontal sync pulses is represented by the symbol T3, and that this duration is less than the duration T1, and the occurrence and duration of the horizontal sync pulses is such that the horizontal blanking occurs at least throughout the duration of each horizontal sync pulse and for a predetermined time thereafter. This insures no loss of active video information during the occurrence of the horizontal sync pulse since the horizontal sync pulses only occur during blank portions of the video signal to be displayed. CRT controllers such as the Motorola and Hitachi controllers noted above readily provide this timing relationship between the signals provided at the terminals 25 through 27.

By analyzing the signals at the terminals A through C it can be seen that NAND gate 50 will provide a high logic state at its output only when the vertical step function is not inhibited in accordance with the signal at the terminal A, the twelfth horizontal scan line has just occurred in accordance with the signal at the terminal C, and the CRT video is in a horizontal blanking mode in accordance with the signal at the terminal B. The output of the NAND gate 50 is provided at a terminal 51 and this signal is representative of a vertical step enable signal which effectively initiates the operation of the interline spacing adjustment circuit 11.

The terminal 51 is coupled as an input to a start/stop bistable circuit 52 which is shown in block form in FIG. 1 and is shown dashed in more detailed form in FIG. 2. Essentially the occurrence of a high logic state at the terminal 51 will result in the bistable circuit 52 providing a low logic signal at a terminal E and a complimentary high logic signal at a terminal E' in response to the first positive transition of the signal at a terminal D' wherein this transition is representative of the first horizontal sync pulse termination (lagging edge) transition that occurs after the occurrence of the signal at the terminal 51. FIG. 2 shows a more detailed embodiment for the bistable circuit 52 wherein it is clear that upon the next termination of a horizontal sync pulse, which corresponds to a positive transition of the signal D', after the creation of a low logic state at terminal E, the bistable circuit 52 will revert to its preceeding logic states wherein a high logic state is provided at the terminal E and a low logic state is provided at the terminal E'.

It should be noted that a prime designation of an alphabetically referenced terminal described herein consistently refers to the fact that the signals at the prime and unprime terminals are logic complimentary signals wherein each merely represents the inverse of the other signal. It should also be noted that the terminal D is representative of a composite horizontal sync signal which is provided to the horizontal sync input terminal 35 of the display terminal 15. The manner in which the composite horizontal sync signal at the terminal D is provided will now be discussed in detail.

The occurrence of a low logic state at the terminal E results in effectively blocking the character clock signal at the terminal 33 from the CLK input terminal of the CRT controller circuit 21. This is accomplished by means of an AND gate 53 which receives inputs from the termials E and 33 and provides its output directly to the input terminal CLK of the CRT controller 21. The significance of this is that upon the occurrence of the low logic state at the terminal E, no further clock pulses are coupled to the CRT controller circuit 21 by the AND gate 53 for a predetermined time. This results in the controller circuit 21 maintaining all of its prior logic state outputs and effectively extending the horizontal blanking pulse until additional clock pulses are coupled as inputs to the controller circuit. This in effect suspends the output states of the CRT controller circuit 21 during the time that the logic state of the signal E is low since the clock pulses received by the controller circuit determine the timing for the creation of its output signals. The dashed portions of the waveforms shown in FIG. 3 for the signals at terminals B and C depict the signals at these terminals in the event that clock pulses are not blocked from the controller circuit 21.

During the time that a low logic state exists at terminal E, the present embodiment will implement a desired vertical step by providing a vertical step signal at the terminal 34, and the present embodiment will also create at least one substitute horizontal sync pulse such that at least one horizontal active scan time $T_2$ and one horizontal retrace time $T_1$ are allowed for completing the desired vertical step between active CRT horizontal scan lines. This is in contrast with prior systems which require the vertical step to occur within the short horizontal retrace time $T_1$ in order to preserve the integrity of the visual display produced by the CRT display station 15. Even without providing a step signal at terminal 34, the present invention implements an effective larger vertical space between horizontal scan line information provided by the refresh memory 19 due to the continuation of horizontal scanning even when the operation of the controller 21 is suspended by the logic output signals of the bistable circuit 52.

Before explaining how the present invention provides the additional time for implementing the vertical step of the horizontal scanning, it should be noted that the bistable circuit 52 merely comprises standard logic elements such as a D-type flip flop 54 and an AND gate 55 both configured as shown in FIG. 2. It should also be noted that preferrably the D-type flip flop 54 is reset upon the initial application of power to the video control circuit 28 wherein this occurs in accordance with a power on reset signal provided at a terminal 56. In addition, it is contemplated that the D-type flip flop 54 will be maintained at a reset state throughout the occurrence of the vertical blanking period of the scanning display and throughout the occurrence of any bottom portion of the scanning display which occurs below a user line that normally separates the active portion of the display from operator information data which may be indicated on the display below a separation line designated as the user line. Each of these functions can be accomplished through the use of an OR gate 57 having one input coupled to the terminal 56 and another input coupled to a terminal 58 while providing its output to the reset terminal R of the flip-flop 54. These functions are provided by having the OR gate 57 operate in conjunction with an OR gate 59 whose output is directly coupled to the terminal 58 and which receives one logic input from a terminal 60 that provides logic signals related to whether or not the horizontal scan is above or below the user line, and wherein a terminal 61 is also coupled as an input to the OR gate 59 wherein the logic state at the terminal 61 is determined by whether or not a vertical blanking pulse is being provided. It should be noted that the signal at the terminal 61 could comprise the vertical blanking signal itself under certain conditions as long as this signal had the proper polarity. The user line related signal at terminal 60 can be provided by a scan line counter in the video control circuit 28.

While the low logic state at the terminal E serves as a clock inhibit signal for the character clock pulses being coupled to the CRT controller 21, the corresponding high logic signal at the terminal E' serves as counter enable signal for a synchronous counter 62 shown in block form in FIG. 1 and in detailed form in FIG. 2. The counter 62 essentially comprises two cascade arranged tens counters 63 and 64 and additional combinational logic which provide logic signals at a number of different occuring counts including a count of one hundred. The character clock signal at the terminal 33 is coupled through an inverter 65 to an effective count input terminal 66 of the counter 62 and thus it is the character clock pulses at the terminal 33 which are effectively counted by the counter 62. At a count of one hundred, the logic state at a terminal $T_c$ of the tens counter 64 provides a high logic state which is coupled through an inverter 67 to a counter output terminal 68. At a predetermined count prior to the count of one hundred a high logic state is provided at a counter output terminal 69 by a NAND gate 70 coupled to various output terminals of the tens counters 63 and 64. Typically, a low logic state is provided at the terminal 69 at a count of 94 while a high logic state is provided at the terminal 68 at a count of one hundred. In addition, a NAND gate 71 is part of the counter 62 and has its inputs coupled to various logic state terminals of the tens counter 64 and provides an output at a counter output terminal 72. The signal at the terminal 72 is high for all counts of the counter 62 from a count of zero through a count of twenty. It should be noted that a count of 100 of the fixed frequency character clock pulses corresponds to the added display active and retrace times $T_2$ and $T_1$.

The terminals 68 and 69 are coupled as controlling inputs to a substitute horizontal sync pulse generator 73 which provides at a terminal G a substitute horizontal sync pulse during the time that the control outputs from the CRT controller 21 are temporarily halted due to the blocking of clock input pulses to the controller circuit 21 by the AND gate 53. FIG. 2 illustrates that the substitute horizontal sync pulse generator 73 comprises a D-type flip-flop which has its clock input terminal directly connected to the terminal 68, its set terminal S connected to the terminal 69, its reset terminal R connected to the terminal E' and its primary output terminal Q connected directly to the terminal G, with the data terminal D of the flip-flop directly connected to ground. With this configuration the substitute horizontal sync pulse generator 73 will provide a positive logic state at terminal G when the counter 62 attains a count of 94, and this high logic state which corresponds to the substitute horizontal sync pulse will terminate at a count of 100. The horizontal sync pulse signal provided at the terminal G is coupled as an input to an OR gate 74 which functions as a signal combiner and receives as an additional input the normal horizontal sync pulse signal provided by the video control circuit 28 at its horizontal sync output terminal F. It should be noted that during the suspension of the activity of the CRT controller circuit 21, of course the video control circuit 28 will not receive additional horizontal sync pulses from the terminal 25 and that therefore no additional horizontal sync pulses will be provided at the terminal F during this time. However, due to the operation of the substitute horizontal sync pulse generator 73, a substitute horizontal sync pulse is provided at terminal G at the proper time during the time that clock pulses are inhibited from reaching the CRT controller circuit 21.

The output of the OR gate 74 is coupled to a terminal D which is directly connected to the horizontal sync input terminal of the CRT display station 15. The signal at the terminal D represents a composite horizontal sync signal which is a combination of the normal horizontal sync pulses provided by the video control circiut 28 at terminal F, which typically corresponds to the horizontal sync pulse signal provided by the CRT controller circuit 21 at the terminal 25, in addition to the substitute sync pulses provided at the terminal G. The terminal D is coupled through an inverter 75 to the terminal D', which as previously stated is coupled to the clock input terminal of the D-type flip-flop 54 of the bistable circuit 52. This configuration results in disabling and resetting the synchronous counter 62 upon the termination of the substitute horizontal sync pulse. This also results in enabling clock pulses to again pass through the AND gate 53 to the controller circuit 21 such that the controller circuit 21 now resumes it character clock pulse counting action and continues its visual display control functions as if nothing had happened. Thus in response to the termination of one of the controller circuit 21 horizontal sync pulse, the flip-flop 54 initiates blocking clock pulses to the controller circuit 21, and in response to at least the termination of one of the substitute horizontal sync pulses the flip-flop 54 will again pass clock pulses.

From what has been described previously, it can readily be seen that the present invention has provided for temporarily suspending the operation of the CRT controller 21 for at least a time duration corresponding to one active horizontal scan period $T_2$ and one retrace horizontal scan period $T_1$. Of course a longer suspension of the activities of the CRT controller 21 could be implemented merely by providing several consecutive horizontal substitute sync pulses through the use of a larger synchronous counter 62.

One aspect of the present invention is the providing of a vertical step to the CRT display station 15 during the suspension of activity of the CRT controller 21 such that the vertical deflection coils of the CRT have sufficient time to implement a larger than normal vertical step between sequential information active horizontal scan lines. It is significant to note that while a larger than normal vertical spacing can be implemented by providing a separate vertical step signal to the terminal 34 during suspension of the controller 21, a larger than normal effective vertical spacing will also be provided even if no separate step signal is provided at terminal 34 due to the occurrence of at least one substitute horizontal scan and retrace while the controller 21 is inactive. This is because since horizontal scanning always continues even when the activity of the controller 21 is halted, a larger than normal vertical space exists between successive horizontal video active scan information recalled by the controller 21 from the refresh memory 19. Thus between times that the refresh memory supplies video excitation information, at least one blank complete horizontal scan sequence will occur while the controller is suspended, and during this horizontal scan sequence the normal downward vertical step will occur resulting in a larger than normal vertical step between the video scan information provided by the refresh memory 19.

In the present embodiment the larger than normal vertical step between horizontal scan lines is implemented by a separate step control signal provided at the vertical step input terminal 34 of the CRT display 15. The signal at this terminal is provided by virtue of a direct connection to a control terminal H which is the output terminal of a vertical step pulse generator 76 that receives input signals by virtue of a direct connection to the terminal 72 of the counter 62 and a direct connection to the terminal E'. The vertical step pulse generator 76 comprises an AND gate 77 having its output directly connected to the terminal H and having one input connected to the terminal 72 and one input connected to the terminal E'. With this configuration the signal at the terminal H comprises a pulse which commences coincidently with the inhibiting of clock pulses to the CRT controller circuit 21 and terminates at an arbitrary count subsequent to this time determined by the configuration of the inputs to the NAND gate 71 wherein in the present example this corresponds to a count of 20 by the counter 62. Of course the duration of this vertical step pulse can be readily altered by changing the logic configuration of the NAND gate 71.

From the above description it is clear that the vertical step pulse provided at the terminal H occurs during the inhibiting of clock pulses to the CRT controller circuit 21. In addition, it is clear that during the occurrence of this vertical step, and for a time thereafter until at least the termination of one substitute horizontal sync pulse, the CRT controller circuit 21 has its output states essentially suspended at their previous values since the controller receives no additional clock pulses. This results in extending the video blanking signal determined by the display timing signal at the terminal 27 of the CRT controller. The fact that the CRT controller circuit 21 will not produce a horizontal sync pulse when its output states are temporarily halted by the inhibiting of clock pulses to the controller is circumvented by the present invention providing a substitute horizontal sync pulse generator which insures that the CRT display station 15 will continue to receive horizontal sync pulses. By virtue of these features, the present invention has provided substantial additional time for the implementation of a vertical step between sequential horizontal scan lines and this has been accomplished without the necessity of any reprogramming of the entire formal program of the CRT controller circuit 21. If such reprogramming were possible, this would require the microprocessor 12 to reinitialize the CRT controller 21 each time a larger than normal vertical step between horizontal scan lines was desired. Obviously this would be an undesirable mode of operation and the need for that type of operation is completely eliminated by the present invention.

A significant aspect of the present invention is that it allows insertion of selectable time delay into a continous synchronous visual display system at an arbitrary point of the display without disruption of data flow or the causing of any visual jitter or flash on the CRT screen. The time delay manifests itself as vertical space between video active scan lines with the space related to the time interval of one or more horizontal scan lines. The information contained in the refresh memory remains intact during the time delay since the internal functions of the CRT controller 21 are suspended during that time although the horizontal sweep system is idling and is pseudo synchronized using generated substitute horizontal sync pulses which therefore cause the display system to appear to function normally .

When the present invention is used in conjunction with a separate vertical step signal applied to terminal 34 ("StepScan"), the time delay may become necessary in order to implement the "StepScan" function using practical vertical sweep control components since, on a selective step basis, the vertical deflection reaction time would otherwise have to take place within the time interval of one retrace time.

While the interline space adjustment of the present can be utilized with a separate vertical step signal and circuit ("StepScan"), it can also function satisfactorily without any such circuit except for possibly providing adjustment for the vertical sweep rate if too many substitute horizontal scan lines occur during the suspension of the controller 21. The number of desired substitute horizontal scan lines, which determines the time interval for the vertical step to be implemented, can be adjusted by altering the count capacity of the counter 62 and by changes to other associated circuitry.

While I have shown and described a specific embodiment of the present invention, further modifications and improvements will occur to those skilled in the art. All such modifications which retain the basic underlying principles disclosed and claimed herein are within the scope of this invention.

What is claimed is:

1. A scanning CRT visual display system in which sequential horizontal visual display lines having predetermined vertical interline spacings between are selectively provided, said display system comprising;

a CRT controlled circuit means for providing vertical and horizontal sync pulses for controlling CRT electron beam sweeping which produces said sequential horizontal visual display lines that together form a composite visual display frame, clock means coupled to said CRT controller circuit means for providing thereto fixed frequency clock timing pulses which determine the occurrence of said vertical and horizontal sync pulses, and a CRT display station means, which includes a CRT for receiving said vertical and horizontal sync pulses, as well as video information signals, and providing said composite visual display frame in accordance therewith;

the improvement comprising an adjustable vertical spacing horizontal interline control circuit comprising the combination of;

terminal means for receiving a vertical step control signal indicative of a desired increase in the normal vertical interline spacing between sequential horizontal scan lines;

gate means coupled between said clock means and said controller circuit means and also coupled to said terminal means for selectively preventing, for a predetermined time, said clock pulses from being received by said controller circuit means in response to at least the occurrence of said step control signal thereby effectively halting the operation of said controller circuit means;

counter means coupled to said terminal means and said clock means for effectively counting said clock pulses during the time that said clock pulses are prevented from being received by said controller circuit means and for providing at least one substitute horizontal sync pulse in response to said counter means attaining a predetermined count of said clock pulses, and signal combiner means coupled to said controller circuit means and said counter means for effectively combining said controller circuit means horizontal output sync pulses and said substitute horizontal sync pulses to provide a composite horizontal sync control signal which is coupled to said CRT display station means for control of said CRT visual display, whereby during the implementation of an increase in the normal vertical spacing between sequential horizontal display lines, horizontal sync pulses are effectively continuously provided even though the time required for implementing the increased vertical spacing may exceed the retrace time normally provided between sequential horizontal visual display lines.

2. A visual display system according to claim 1 which includes a visual display refresh memory means for storing information signals which define a desired predetermined visual frame pattern which is to be displayed, and character generator means coupled to said refresh memory means for receiving the stored signals in said refresh memory means and sequential providing individual character display signals to said CRT display station means to produce a desired visual display, the operation of said refresh memory means and said character generator means being controlled by said controller circuit means.

3. A visual display system according to claim 1 wherein a said counter means which supplies said substitute horizontal sync pulses is operatively enabled during the time clock pulses are blocked from said controller circuit means by said gate means.

4. A visual display system according to claim 3 wherein said step control signal at said terminal means is effectively coupled to a vertical beam deflection control means of said CRT, a horizontal beam deflection control means of said CRT receiving said composite horizontal sync signal.

5. A visual display system according to claim 4 wherein said controller circuit means includes any of the group of integrated circuits consisting of Motorola CRT controller circuit MC6845 and Hitachi controller circuit HD46505R.

6. A visual display system according to claim 3 wherein said controller circuit means provides a video blanking signal during the existence of its horizontal sync output signals and for a time thereafter, the video blanking signal being coupled to said CRT for controlling blanking of the video on said CRT during these horizontal sync pulses and for at least a predetermined time thereafter.

7. A visual display system according to claim 6 in which said controller circuit means provides, in response to the occurrence of said vertical step control signal pulse and the effective subsequent occurrence of one of said horizontal output sync pulses of said controller circuit means, an effective extension of said video blanking signal from said controller circuit means, the video blanking signal being extended during the time clock pulses are prevented from being received by said controller circuit means until at least the occurrence of one substitute horizontal sync pulse provided by said counter means.

8. A visual display system according to claim 7 wherein said gate means includes logic circuitry which couples said horizontal sync pulses provided by said controller circuit means and said vertical step control signal from said terminal means to said gate means for control thereof.

9. A visual display system according to claim 7 wherein said gate means prevents said controller circuit means from receiving said clock pulses in response to a horizontal sync pulse provided by said controller circuit means and again permits the passage of said clock pulses in response to at least one substitute horizontal sync pulse provided by said counter means.

10. A visual display system according to claim 9 wherein said gate means is responsive to the termination of one of said controller horizontal sync pulses and one of said counter means substitute horizontal sync pulses to alternately prevent and pass said clock pulses to said controller circuit means.

11. A visual display system according to claim 1 wherein said gate means prevents said controller circuit means from receiving said clock pulses in response to a horizontal sync pulse provided by said controller circuit means and again permits the passage of said clock pulses in response to at least one substitute horizontal sync pulse provided by said counter means.

12. A visual display system according to claim 11 wherein said gate means is responsive to the termination of one of said controller horizontal sync pulses and one of said counter means substitute horizontal sync pulses to alternately prevent and pass said clock pulses to said controller circuit means.

* * * * *

UNITED STATES PATENT AND TRADEMARK OFFICE

CERTIFICATE OF CORRECTION

PATENT NO. : 4,434,420

DATED : February 28, 1984

INVENTOR(S) : Joseph Bujalski

It is certified that error appears in the above-identified patent and that said Letters Patent is hereby corrected as shown below:

In column 14, line 1 (claim 1), delete "controlled" and insert --controller--.

In column 14, line 67 (claim 3), delete "a".

Signed and Sealed this

*Fourth* Day of *December 1984*

[SEAL]

*Attest:*

GERALD J. MOSSINGHOFF

*Attesting Officer*

*Commissioner of Patents and Trademarks*